US010841028B2

(12) United States Patent
Kline et al.

(10) Patent No.: US 10,841,028 B2
(45) Date of Patent: Nov. 17, 2020

(54) SYSTEM AND METHOD FOR ANALYZING USER-SUPPLIED MEDIA AT A SPORTING EVENT

(71) Applicant: FanThreeSixty, LLC, Kansas City, MO (US)

(72) Inventors: Nic Kline, Kansas City, MO (US); Bart Hampton, Kansas City, MO (US)

(73) Assignee: FanThreeSixty, LLC, Kansas City, MO (US)

( * ) Notice: Subject to any disclaimer, the term of this patent is extended or adjusted under 35 U.S.C. 154(b) by 0 days.

(21) Appl. No.: 16/552,275

(22) Filed: Aug. 27, 2019

(65) Prior Publication Data

US 2020/0076523 A1 Mar. 5, 2020

Related U.S. Application Data

(60) Provisional application No. 62/723,656, filed on Aug. 28, 2018.

(51) Int. Cl.

| | |
|---|---|
| ***H04H 60/64*** | (2008.01) |
| ***H04H 60/33*** | (2008.01) |
| ***H04H 60/45*** | (2008.01) |
| ***H04H 20/12*** | (2008.01) |

(52) U.S. Cl.

CPC ..... *H04H 60/64* (2013.01); *H04H 20/12* (2013.01); *H04H 60/33* (2013.01); *H04H 60/45* (2013.01)

(58) Field of Classification Search

CPC ..... H04H 60/64; H04H 20/12; H04H 60/33; H04H 60/45

See application file for complete search history.

(56) References Cited

U.S. PATENT DOCUMENTS

| | | | | |
|---|---|---|---|---|
| 2013/0132836 | A1* | 5/2013 | Ortiz | H04N 1/32101 715/716 |
| 2014/0152834 | A1* | 6/2014 | Kosseifi | H04N 7/181 348/158 |
| 2015/0347827 | A1* | 12/2015 | Dickinson | G06K 9/00302 382/103 |
| 2016/0234556 | A1* | 8/2016 | Berridge | H04N 21/4758 |
| 2016/0292511 | A1* | 10/2016 | Ayalasomayajula | G06K 9/00751 |
| 2019/0013047 | A1* | 1/2019 | Wait | G11B 27/3081 |

* cited by examiner

*Primary Examiner* — John R Schnurr
(74) *Attorney, Agent, or Firm* — Erise IP, P.A.

(57) ABSTRACT

A system and method of analyzing and presenting user-supplied media at a sporting event is described herein. A user may collect data using a mobile device at a sporting event. The data may be analyzed by an application on the mobile device to determine if the data comprises an event at the sporting event. The data may be combined with data from a plurality of mobile devices to create a combined data set for distribution. The fan may be rewarded for the contribution to the combined data set.

20 Claims, 3 Drawing Sheets

SYSTEM AND METHOD FOR ANALYZING USER-SUPPLIED MEDIA AT A SPORTING EVENT

RELATED APPLICATION

This non-provisional patent application claims priority benefit, with regard to all common subject matter, of earlier-filed U.S. Provisional Patent Application No. 62/723,656 filed Aug. 28, 2018 and entitled SYSTEM AND METHOD FOR ANALYZING USER-SUPPLIED MEDIA AT A SPORTING EVENT. The identified earlier-filed provisional patent application is hereby incorporated by reference in its entirety into the present application.

BACKGROUND

1. Field

Embodiments of the invention relate to providing an interactive experience for a fan at a sporting event. More specifically, embodiments of the invention relate to identifying events and analyzing and displaying fan-generated media at a sporting event.

2. Related Art

Typically, at sporting events, cameras are placed strategically around a sporting venue to capture the play on the field, court, or rink, and the reactions of the fans in attendance at the event. Occasionally events will transpire at the sporting event that the cameras fail to capture such as, for example, a person on the field, action away from a ball, or a wedding proposal in the stands. These events may not be a scheduled part of the action therefore cameras are not pointed in the direction of the action. These events may go unnoticed or may be reported on with no video to view the events.

What is needed is a system that interacts with the fans and displays media acquired from the fans to depict the fan's vantage point and display additional action from the stands or on the field that the traditional cameras do not capture. Utilizing the fans and the cameras that are now commonplace in the stands, broadens the scope of what can be captured at the sporting events. Enabling the users to upload fan-generated data increases interaction with the fans and the system administrators and promotional partners and allows the fans to add their own media to a sporting event. The media content may be combined with uploaded media from other fans to create promotional advertisements for products or the sporting teams. Fans that are not in attendance at the sporting event may also be able to view the media creating excitement and drawing more fans to the sporting venue thus increasing attendance.

SUMMARY

Embodiments of the invention address the above-described need by providing for a variety of techniques for improving the fan experience. In particular, in a first embodiment, the invention includes a method of analyzing user-supplied media at a sporting event, the method comprising the steps of collecting data from a mobile device at the sporting event, wherein the data is indicative of activities at the sporting event, determining that the data is indicative of an event, distributing the data for broadcast of the event, and providing rewards to a user of the mobile device based at least in part on the data.

In a second embodiment, the invention a method of analyzing user-supplied media at a sporting event, the method comprising the steps of collecting data from a mobile device at the sporting event, wherein the data is indicative of activities at the sporting event, determining at least one marker from the data, wherein the at least one marker is indicative of an event, and providing rewards to a user of the mobile device based at least in part on the data.

In a third embodiment, the invention includes one or more non-transitory computer-readable media storing computer-executable instructions that, when executed by a processor, perform a method of analyzing user-supplied media at a sporting event, the method comprising the steps of collecting a first set of data from a first mobile device at the sporting event, wherein the first set of data is indicative of activities at the sporting event, determining at least one marker in the first set of data, collecting a second set of data from a second mobile device at the sporting event, wherein the second set of data is indicative of the activities at the sporting event, and combining the first set of data and the second set of data to create a combined set of data based at least in part on the at least one marker.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the current invention will be apparent from the following detailed description of the embodiments and the accompanying drawing figures.

BRIEF DESCRIPTION OF THE DRAWING FIGURES

Embodiments of the invention are described in detail below with reference to the attached drawing figures, wherein.

Figure 1:
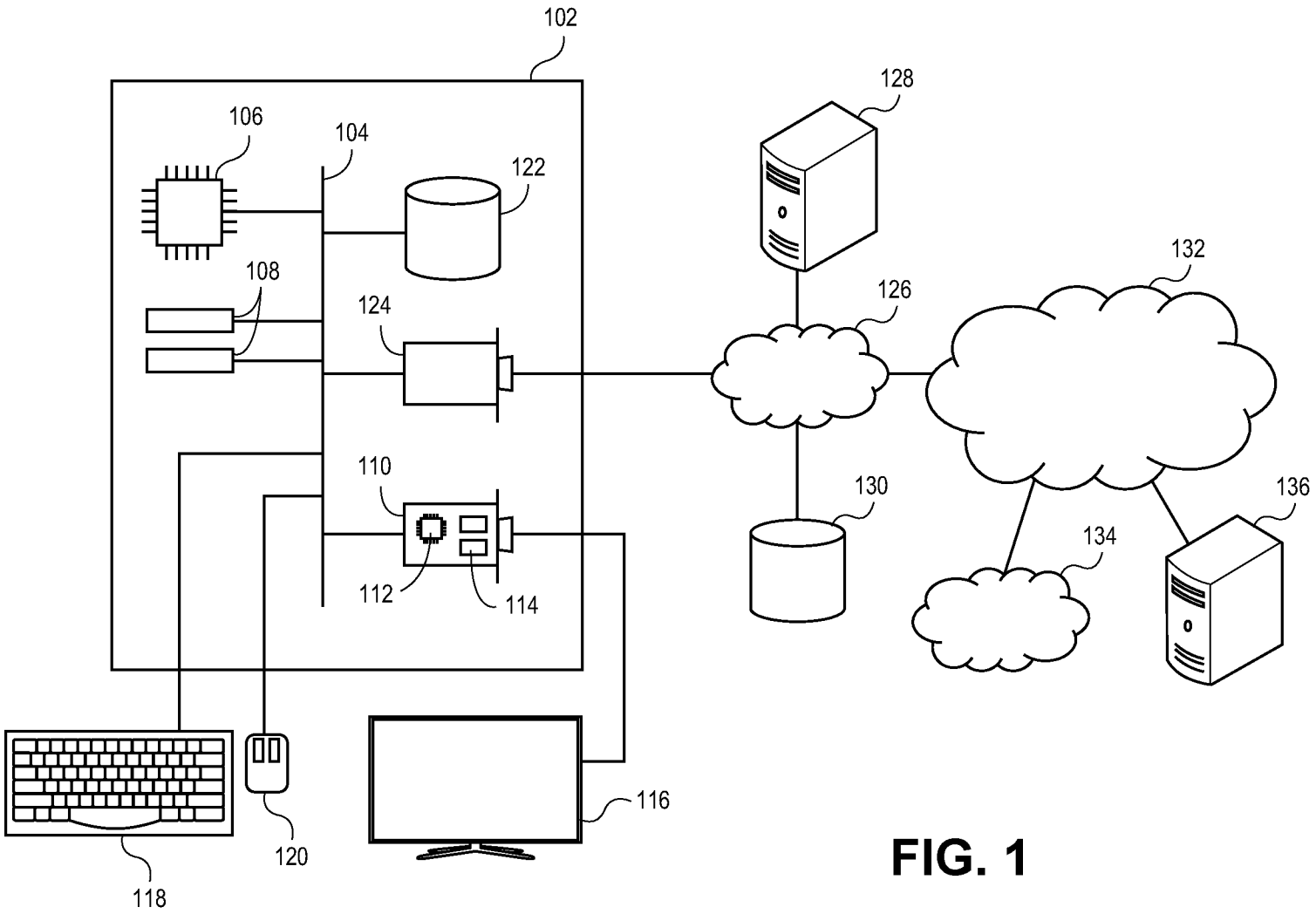
FIG. 1 depicts an exemplary hardware platform for certain embodiments of the invention.

The drawing figures do not limit the invention to the specific embodiments disclosed and described herein. The drawings are not necessarily to scale, emphasis instead being placed upon clearly illustrating the principles of the invention.

DETAILED DESCRIPTION

Broadly, embodiments of the invention provide an interactive system to fans at sporting events. The fans may provide fan-generated data in the form of audio, video, or images of the sporting event or the sporting environment. The sporting environment may include the sporting event, any entertainment at the event, and fans. The data may be uploaded through a mobile application, through the cloud, or to a central database. The data may be analyzed for markers related to information that may be useful to system administrators. In general, the data may be indicative an event such as, for example, action at the sporting event or sponsors items located in the stands or on billboards. The data may be combined or stitched together with data from other fans to create a final user-generated medium that may be used for advertising and sent back to the fans and shared with the fans or officials at the sporting event and broadcast on social media, via live-streaming platforms, radio, and broadcast television. The fans may be awarded points, money, and reduced or free items such as tickets and concessions for the uploaded data. The data may be tracked logging social media shares and number of views. Characteristics within each final video may be associated with the number of views and shares to determine characteristics that reach the largest audience. These characteristics may become new markers that the system automatically searches to create optimized final videos that generate the most excitement and reach the largest audience.

The following description of embodiments of the invention references the accompanying illustrations that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the invention. The following detailed description is, therefore, not to be taken in a limiting sense.

In this description, references to "one embodiment", "an embodiment", "embodiments", "various embodiments", "certain embodiments", "some embodiments", or "other embodiments" mean that the feature or features being referred to are included in at least one embodiment of the technology. Separate references to "one embodiment", "an embodiment", "embodiments", "various embodiments", "certain embodiments", "some embodiments", or "other embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the current technology can include a variety of combinations and/or integrations of the embodiments described herein.

Turning first to FIG. 1, an exemplary hardware platform that can form one element of certain embodiments of the invention is depicted. Computer 102 can be a desktop computer, a laptop computer, a server computer, a mobile device such as a smartphone or tablet, or any other form factor of general- or special-purpose computing device. Depicted with computer 102 are several components, for illustrative purposes. In some embodiments, certain components may be arranged differently or absent. Additional components may also be present. Included in computer 102 is system bus 104, whereby other components of computer 102 can communicate with each other. In certain embodiments, there may be multiple busses or components may communicate with each other directly. Connected to system bus 104 is central processing unit (CPU) 106. Also attached to system bus 104 are one or more random-access memory (RAM) modules 108. Also attached to system bus 104 is graphics card 110. In some embodiments, graphics card 104 may not be a physically separate card, but rather may be integrated into the motherboard or the CPU 106. In some embodiments, graphics card 110 has a separate graphics-processing unit (GPU) 112, which can be used for graphics processing or for general purpose computing (GPGPU). Also on graphics card 110 is GPU memory 114. Connected (directly or indirectly) to graphics card 110 is display 116 for user interaction. In some embodiments no display is present, while in others it is integrated into computer 102. Similarly, peripherals such as keyboard 118 and mouse 120 are connected to system bus 104. Like display 116, these peripherals may be integrated into computer 102 or absent. Also connected to system bus 104 is local storage 122, which may be any form of computer-readable media, and may be internally installed in computer 102 or externally and removeably attached.

Computer-readable media include both volatile and nonvolatile media, removable and nonremovable media, and contemplate media readable by a database. For example, computer-readable media include (but are not limited to) RAM, ROM, EEPROM, flash memory or other memory technology, CD-ROM, digital versatile discs (DVD), holographic media or other optical disc storage, magnetic cassettes, magnetic tape, magnetic disk storage, and other magnetic storage devices. These technologies can store data temporarily or permanently. However, unless explicitly specified otherwise, the term "computer-readable media" should not be construed to include physical, but transitory, forms of signal transmission such as radio broadcasts, electrical signals through a wire, or light pulses through a fiber-optic cable. Examples of stored information include computer-useable instructions, data structures, program modules, and other data representations.

Finally, network interface card (NIC) 124 is also attached to system bus 104 and allows computer 102 to communicate over a network such as network 126. NIC 124 can be any form of network interface known in the art, such as Ethernet, ATM, fiber, Bluetooth, or Wi-Fi (i.e., the IEEE 802.11 family of standards). NIC 124 connects computer 102 to local network 126, which may also include one or more other computers, such as computer 128, and network storage, such as data store 130. Generally, a data store such as data store 130 may be any repository from which information can be stored and retrieved as needed. Examples of data stores include relational or object oriented databases, spreadsheets, file systems, flat files, directory services such as LDAP and Active Directory, or email storage systems. A data store may be accessible via a complex API (such as, for example, Structured Query Language), a simple API providing only read, write and seek operations, or any level of complexity in between. Some data stores may additionally provide management functions for data sets stored therein such as backup or versioning. Data stores can be local to a single computer such as computer 128, accessible on a local network such as local network 126, or remotely accessible over Internet 132. Local network 126 is in turn connected to Internet 132, which connects many networks such as local network 126, remote network 134 or directly attached computers such as computer 136. In some embodiments, computer 102 can itself be directly connected to Internet 132.

In some embodiments, the application may run on a computer or mobile device or be accessed via the computer or mobile device and run in a web-based environment from the recipient's web browser. The web-based environment may store data such that it is not required for the mobile device or computer to have downloaded and stored large amounts of data for the application. The application may access data such as object databases, user profiles, information related to other users, financial information, third party financial institutions, third party vendors, social media, or any other online service or website that is available over the Internet.

Broadly, embodiments of the invention relate to providing an interactive system such that users may share media and digitally communicate individual experiences within a common environment. The shared media may be used by the system administrator to provide feedback, advertising, or incentives to the users. The shared media may also be shared between users privately and publicly to individuals outside of the system. The shared media may be access by the user through a personal account that may be private or public and may be customized by the user. Generally, in some embodiments, the system may track, broadcast, and promote sporting events utilizing the user-generated shared media. The shared media may be displayed on social media, television broadcasting companies, streaming platforms, or may be sent to other user's devices directly.

Figure 2:
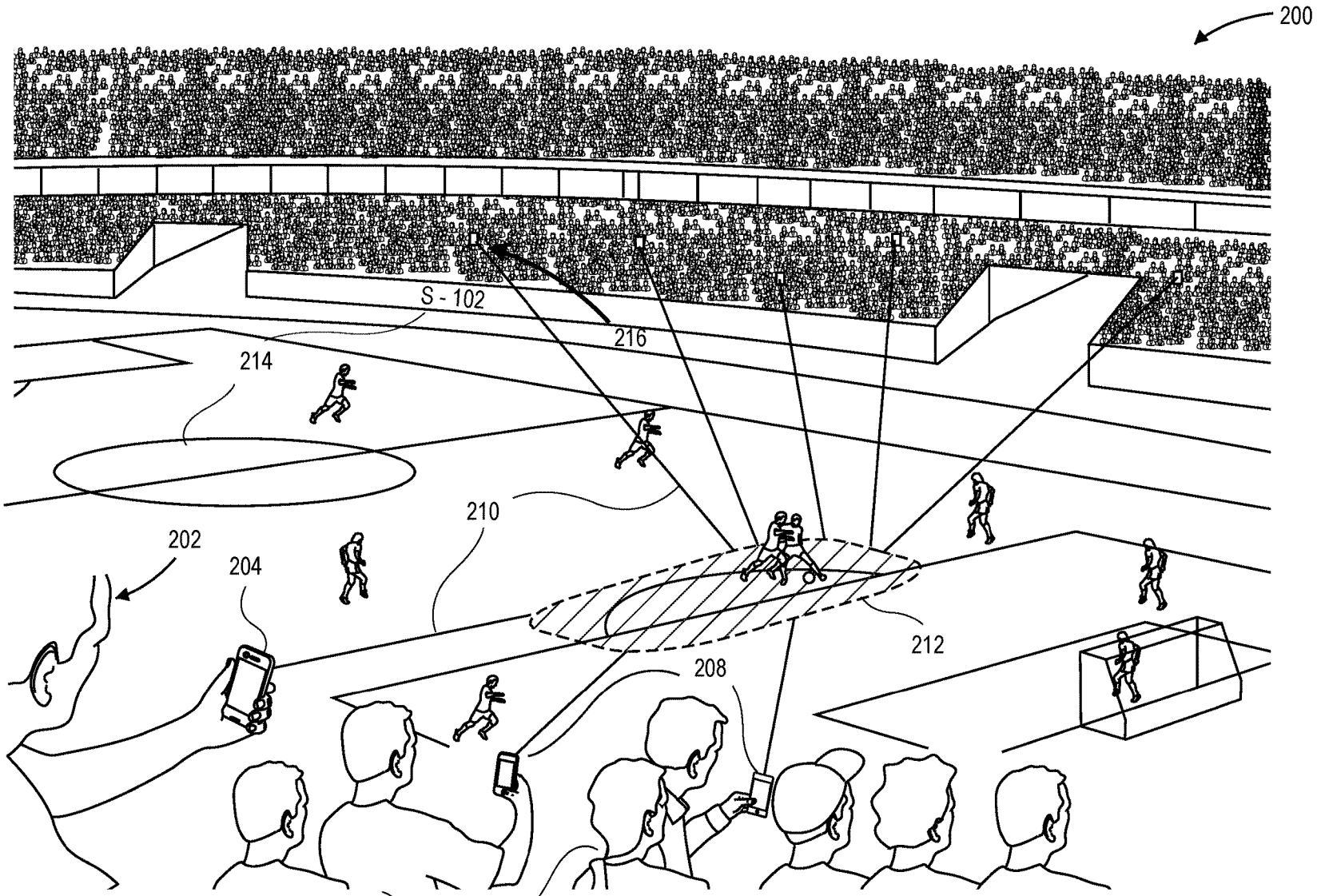
FIG. 2 depicts an exemplary scenario for utilizing embodiments of the invention.

FIG. 2 depicts an exemplary embodiment of the invention where fans record events at the sporting event. The sporting venue 200 may be attended by a fan 202 that may be a user of the system or application. The fan 202 may record the sporting event, which in the example depicted is a soccer game, with a mobile device 204. Other fans 206 may concurrently record the soccer game. The fans 206 may use the mobile devices 208 to record activities on or off the soccer field. The direction the cameras of the mobile devices 208 are represented by direction lines 210 and zone 212 may represent a general area that is determined by the application to be a focal point of the cameras. Information indicative of the source-geolocation and compass-based orientation of the mobile devices 208 and the mobile device 204 may be analyzed in real time to determine the direction of the cameras associated with the mobile devices 208 and the mobile device 204. A buffer may be used to analyze content and splice together information from the mobile devices 208 in near real-time playback. In some embodiments, the information from the mobile device 204 and the mobile devices 208 may be analyzed to determine an estimated location of the zone 212. In some embodiments, the location of the zone 212 may be determined and narrowed for accuracy based on combined information from the mobile devices 208 and the mobile device 204. For example, it may be determined from information received from the mobile device 204 that an event is taking place out of the view of commercial cameras covering the sporting event. The information such as, for example, compass-based information, location, and orientation, from the mobile device 204 may be analyzed to determine the direction of the camera of the mobile device 204. Information from the mobile devices 208 may be analyzed to determine an accurate location for the zone 212 by analyzing the location and the orientation of each of the mobile devices and, for example, determining direction lines 210 to determine the zone 212 such as, for example, using triangulation methods. In some embodiments, the precise location of the action on the field may be determined from the mobile device 204 and in some embodiments other non-scheduled events may be recorded by the mobile device 204.

In some embodiments, physical markers 214 in the field of view of the cameras such as signs, seat markers, section markers, as well as augmented reality markers may be stored and the relative locations in the view of the images along with the seat location or the mobile device 204 location and the location of the user 202 taking the images may be used to determine the orientation of the mobile device 204 and the location of the focal point of multiple mobile devices 208. In some embodiments, markers may be the physical markers 214 and information indicative of the mobile device 204 or sensors associated with the mobile device 204 such as accelerometers, GPS, gyroscopes, and compass-based sensors, for measuring movement, location, and orientation of the device. In some embodiments, markers may be used by the system from the recordings of the mobile devices to determine the mobile device 208 that captured the event. The methods described herein may be used to determine a general or precise location and may be used to determine a location on the field, in the stands, in the sky or any location that may be viewable from within the sporting venue 200. For example, at a soccer game, the location may be the existence of a red or a yellow card in the images. The location may also be determined by a referee uniform or Augmented Reality (AR) markers on the field or in the stadium. The AR markers may also be placed on the players clothing for player identification and location recognition or sporting equipment such as at each goal identifying the direction and orientation as well as which team the goal the team may be defending.

Action on the field may be caught by the mobile devices 208 cameras, or professional cameras that may be used by the users of the application, such that the commercial entity broadcasting the event may use the information to display different angles and perspectives of the action at the sporting venue 200. For example, many different sports are using different camera angles and perspectives in integrating instant replay to determine close or missed plays. For example, in soccer, instant replay is used at the goal-line. In football, instant replay is used to determine if a player made a reception or fumble. In baseball, instant replay is used to determine if a player is safe or out in close plays at a base. It may be difficult to determine the outcome of these plays because a player's foot or hand may be blocking a camera angle or another player, not involved in the play, may be blocking a camera. These stationary commercial cameras do not provide 360 degree coverage of any play thus resulting in missed angles and points of view. The mobile devices 208 may be accessed for different camera angles for the officials and fans to view to make up their own minds. The information obtained from the mobile device 208 may also be combined with the commercial cameras.

In some embodiments, the system may look for the markers, as described above, to determine the data from the mobile devices 208 that may be used. For example, the marker may be information obtained from sensors associated with the mobile device 204 indicating that the camera of the mobile device 204 is pointed in the direction of the close play and active. Access may be given by the user of the mobile device 204 and the information analyzed by the system or an administrator to determine if the information is usable for the intended purpose (e.g., instant replay). The information, such as, for example, the video recorded by the camera may be played for officials or fans to view. The information obtained from the mobile device 204 may also be used for promotional purposes and incentives or rewards may be provided to the user 202 based at least in part on the information obtained from the mobile device 204.

If it is determined that the exemplary video collected by the mobile device 204 is useful, the system may use the mobile device 204 information to determine other devices that may have collected useful information. For example, if the video data is useful, the system may look for other mobile devices 208 in the same or similar location to the mobile device 204 to gather more information such as, for example, video, audio, and images of the event from the same or similar perspective. In some embodiments, the system or an administrator may determine that it may be necessary or useful to view the event from a different angle than that of the mobile device 204. From the video and an analysis of the location from which the video was recorded, it may be determined that useful information may be obtained from section 102 of the stadium. This may be determined by the location viewed in the video or from obtained location and direction information from the mobile device 204. The alternative mobile device 216 may be accessed to obtain information from the perspective of section 102 of the stadium (shown by the "S—102" sign in FIG. 2). The information from any mobile device may be combined to create a three dimensional view of the play such that the exemplary officials and fans have full coverage of the close play event. The user 202 of the mobile device 204 may then be provided incentives such as loyalty points to a loyalty program which may be redeemable for tickets, concessions, or any number of promotional items. These added benefits and the user viewing their recordings also add to the user experience at the sporting event.

In some embodiments, triggering events may be used to determine when events occur and when data is stored and obtained by the application. The event, such as, for example, a close play or a scoring play, as described above, may be detected using sensors available on the mobile device 204 such as a microphone, accelerometer, gyroscope, GPS, or any other sensor that may detect an event. The sensors may provide markers such as crowd noise, acceleration indicative of fan movement, or any other marker obtained from a sensor associated with the mobile device 204 that may provide an indication that an event has occurred. For example, an exciting play may occur at the sporting event and the crowd cheers. A microphone associated with the mobile device 204 may detect the cheering and the application may recognize that the noise level at the stadium has increased. The noise may be compared to stored crowd cheering signals to recognize if the crowd is cheering or booing. In this way the application may associate the noise at the stadium with positive or negative plays. Similarly, the detection of the event may be the application detecting a sensor output such as an accelerometer. The accelerometer output may indicate that the fan 202 has raised their arms quickly or jumped. This action may be indicative of a celebration of a good play and the application may initiate some action based on the input.

In some embodiments, a recognized input may initiate storage and submission of the data. In some embodiments, the camera may be running and capturing the sporting event in real time. Storage of the events captured is stored for a predetermined time and the storage is running on a loop. For example, any data generated may be stored for thirty seconds then new data overwrites the stored data. In this way, only a certain amount of storage is necessary while recording in real time during the sporting event. The thirty-seconds of stored data is stored durably when the triggering event described above initiates storage. The triggering event may also automatically submit the data for analysis or the user 202 may review the stored data before submission.

In some embodiments, unexpected events may occur on the field or in the stands that the cameras designated to capture the sporting event may not capture. For example, a mascot at a sporting event may go into the stands to meet with fans. The cameras at the sporting event may not be close to the action and therefore may not provide good coverage of the event. The location of the mascot may be tracked using the mobile devices 208 recording in proximity utilizing markers of the mascot in analyzed data or the mascot may carry an AR tag (visible indicia), RFID for location in proximity to the mobile devices 208, and may have a GPS sensor for tracking. Any mobile devices associated with the system in proximity to the mascot may be broadcast live or with a delay to show the interactions of the fans with the mascot. In some embodiments, the mascot may have a designated route to follow and the fans along the route may be notified that the mascot is on the way such that the fans are ready to record the interactions. Any events that may occur in the stands or in view of fans such as, for example, marriage proposals, altercations, plays on foul balls, and security interactions may be recorded by the fans and analyzed to be used for the event, disciplinary, or for promotional purposes.

Figure 3:
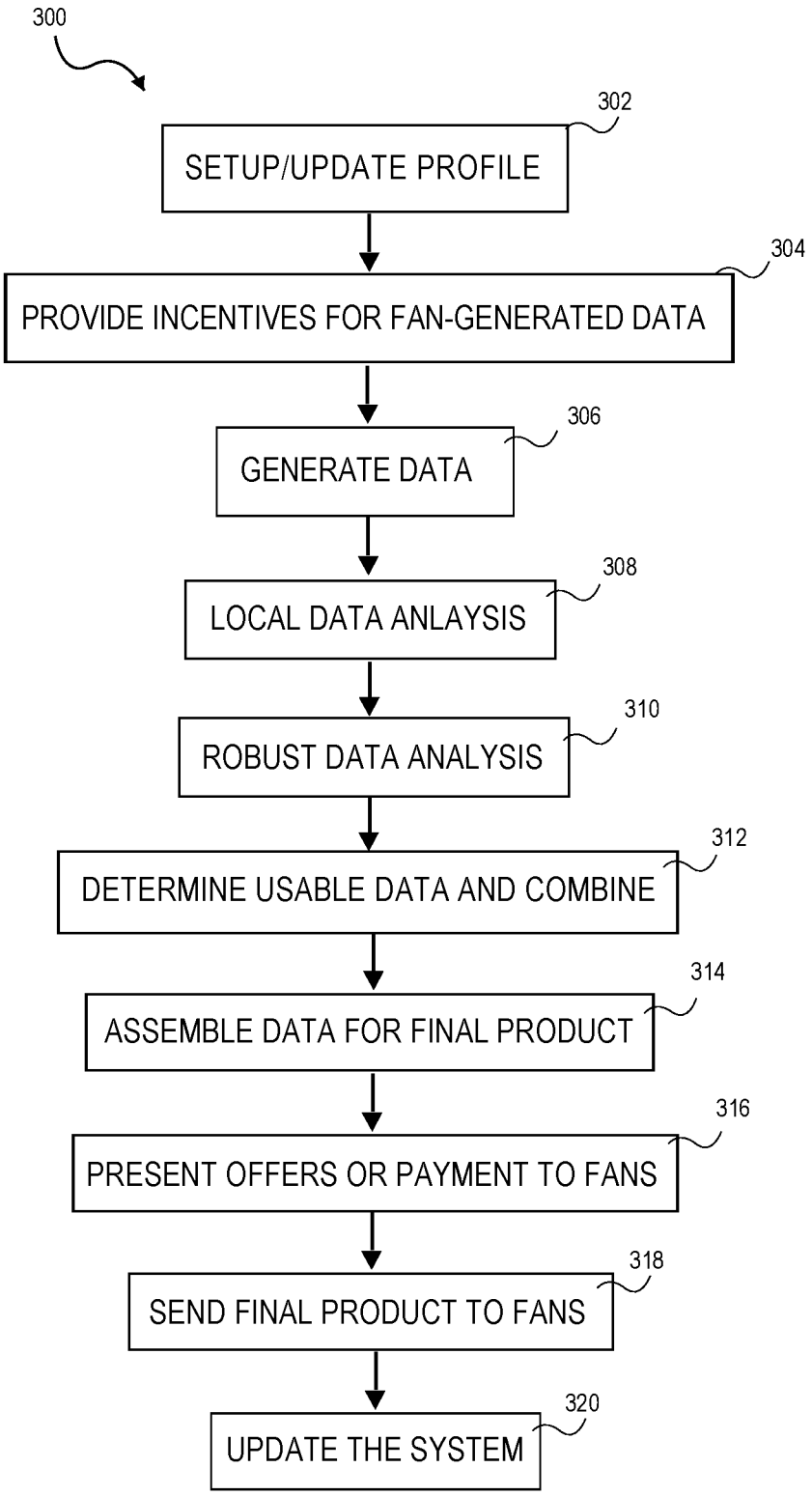
FIG. 3 depicts a flowchart for methods in accordance with embodiments of the invention.

Some embodiments of the invention may be represented by the exemplary method 300 depicted in FIG. 3. Initially at step 302, the application is downloaded on the mobile device 204 or computer or accessed via the Internet or in a cloud based application or system. The fan 202, in the exemplary case of a new user, is prompted to set up a profile for use with the application. The fan 202 may input such exemplary items as age, gender, nationality, favorite teams, favorite players, favorite arenas, favorite venue for watching games outside of the arena, favorite seats or locations within the arena, smoker or nonsmoker, or any other information that may be used to create customized offers and a unique experience for the fan 202. The fan 202 may also list personal preferences such as brands of clothing and food and beverage preferences. The fan 202 information may be stored in a database associated with a fan profile.

The fan profile may be accessible and editable by the fan 202, the system administrator, and portions of the information associated with the fan profile may be shared with team sponsors. Any information associated with the fan 202 and the fan profile may be used to offer advertisements and incentives to the fan 202. The information on the fan profile may be used in combination with information on other fan profiles and information gathered on the Internet to formulate statistical models that may be applied to users of the system for the purposes of gathering and presenting relevant information to the users. The content may also be used to present promotional advertising to individuals or groups of people using audio, video, tactile, or by activating any other senses.

The fan profile may also indicate if a user is a member of a loyalty program. The loyalty program may include special offers for long-time members or members that frequently use the application and update information on the application. The loyalty program may be associated with the fan profile and include any information associated with the fan. Rewards and incentives may be applied to a loyalty program accessible via the fan profile.

At a step 304, the application may suggest, or provide incentives to the user 202 to collect data. The incentives may be in the form of ticket upgrades, reduced prices for tickets or concessions, loyalty points, money, vouchers for sponsorship items, or any other benefit that a user may desire. For example, a sports drink associated with the sporting team may offer free drinks to fans that upload images of fans drinking the sports drink at the sporting event. The fans take videos and selfies drinking the sports drink with the game in play behind them and receive vouchers via the mobile application for free sports drinks. The uploaded videos may be used for promotional advertisements by the sports drink company or the sporting team and may earn rewards for the user 204 that uploaded the media used for the promotion. Incentives may be sent or offered to gain specific data such as marketing logos or to achieve specific effects such as slow motion or resolution and lighting requirements. The requests may be accompanied by incentives such as free tickets, artistic recognition, reduced concessions, loyalty points, or money.

At a step 306, the fan 202 at the sporting event may take a photo, video, audio, or utilize any other medium to collect, store, and send data. The fan 202 may use any sort of handheld or mounted camera, professional camera, microphone, or mobile device such as a smart phone or tablet. The fan 202 may collect the data and submit the data to the application on the mobile device 204 or send the data to a central server. The fan 202 may record on-the-field action, action in the stands, and halftime entertainment. The fan 202 may continuously record or record events in accordance with the incentives provided at step 304. Alternatively, the fan 202 may take photographs or videos of the event for their own purposes. For example, the fan 202 may see an exciting play occurring and wish to capture it on video for their own purposes. Such videos can be employed in all the same ways that incentivized videos can be used.

The application running on the mobile device 204 may collect additional information from the mobile device 204 and applications and information associated with the mobile device 204 to associate with the obtained data. The mobile device 204 may collect associated metadata and any information from mobile device sensors such as gyroscopes, accelerometers, GPS, proximity sensors or any other sensors that may be utilized by the mobile device 204. By collecting this data, it is possible to determine exactly where each fan is located and the direction and orientation of the mobile device 204 and the direction the mobile device camera is pointing. This data may be used in combination with other mobile devices 208 and sensors to determine locations of events and products as described above.

Similarly, the sensors on the mobile device 204 may be utilized to initiate recordings or send incentives. For example, an exciting play may cause the crowd to make loud noises or may cause the fan 202 to thrust their arms into the air or jump. These actions may generate sensor data that is known from an analysis of stored historical data to occur during exciting events. Based on the sensor data and the associated exciting event the application may automatically initiate recording or send incentives. For example, a goal is scored at the sporting event and the application, receiving sensor information, senses that the fan has jumped up into the air. The application sends a message to the fan "send us a video of your section cheering and receive free concessions for the second half of the game."

The sensor data may also be used in combination with game tracking analytics. The application may use location information as well as real-time tracking of a play-by-play analysis to track the game. Increased noise at the stadium may be linked to a particular home team that has the ball as determined through the in-game tracking and determine that a good play for the home team has occurred. This may be used to activate the recording device of the mobile device 204 or send incentives to the user to record.

The user 202 may stream a live feed or pre-recording may be employed such that the memory of the mobile device 204 is not used for storing more than a predetermined amount of data while recording as described above. This may enable the user 202 to use their mobile device 204 without filling storage space and only store exciting events. Further, the application may initiate storage of pre-recorded data based on the sensors of the mobile device 204. For example, the user 204 may have the video in pre-recording mode. An exciting play occurs and the crowd cheers automatically initiating the storage of the pre-recorded event. The length of time, or amount of data, stored at any particular time may be edited based on the sporting event. For example, a football play may last approximately 8 seconds from beginning to end. In this example there is no need to store more than 15 seconds, for example, since the play will be completed within this time frame. This allows the fan 204 to enjoy the event without having to initiate storage every time an exciting event occurs. Further, upon storing the data, the data may be automatically analyzed at the mobile device 204 or sent for analysis without the input of the user 202.

In some embodiments, the application analyzes the data in real time looking for markers and when the markers are discovered the application initiates storage and submission of the data. For example, system administrators may have a desire to promote a certain soft drink. The application may be set to analyze the mobile device 204 data recordings in real time for markers such as, for example, the soft drink label. In some embodiments, the markers may be promotional items such as product labels for teams, sports drinks, food, restaurants, vendors, or any other commercial entity that may be used for promotional purposes. When the marker is recognized, the data is stored and submitted for further review. When the stored data is selected for promotional use, the fan 204 automatically receives a reward for a free soft drink at the concessions stand along with a notification that the image was received from the fan 202 mobile device 204. The fan 204 may then view the image from the mobile device 204 on the big screen at the sporting event.

At a step 308, the system may perform a local low-level analysis of the data at the mobile device 204 to determine clarity and quality before the data is sent to the cloud, or central server, for a more robust analysis. The low-level analysis may filter the amount of data to only usable data that is clear and contains markers rather than sending large amounts of unusable data to be analyzed at the central server. The low-level analysis may analyze quality to determine if the resolution and lighting is useable. Further, only small portions of data or low resolution analysis may be performed to reduce the amount of data analyzed and quicken the process. The local analysis may also provide direct and immediate feedback to the fan 202 that recording parameters may need adjusting such as lighting, zoom, or technique. At any step additional information such as recording instructions may be sent to the user 202 to comply with data requirements of the system. The data may be compressed and sent to the central server for further analysis. The data may be filtered based on information in the data. The data may be filtered according to a desired effect to present the media such as slow motion video. The different media types may be incentivized by administration of the application. In the exemplary case of slow motion, the camera shutter speeds may be used to group like images or images taken at the same speed such that the images may be spliced together creating slow motion effects from multiple sources. The instructions may also increase the probability that the fan-generated data will be used in the final product.

Once the low-level analysis is complete a compressed or uncompressed version of the data may be sent to the cloud for analysis. This may be performed to further reduce the data to be analyzed in a second, more robust, analysis. Once the data passes the second analysis the full data set may be requested for further analysis or for processing, production, and distribution.

At a step 310, the system may analyze the data in the second data analysis to determine if the data may be used for advertisements or promotional material. Once the compressed data has been analyzed and is designated as possibly usable the system may obtain the full data set from the mobile device 204. The full data set may be automatically analyzed and reviewed by the system and administrators to determine if the information is usable and processed. For example, a video including imagery taken at the sporting event may be spliced together to create an advertisement to play on a large screen display to the fans at the sporting venue. The video may be scanned to determine how many times the sporting team or the mascot of the team is depicted. The video also may be scanned to determine how many instances of a marketing partner's beverage or a clothing brand is depicted. The video may also be compared to possible candidate for splicing to determine if the quality, resolution, and lighting is similar such that the splicing of the images quality is consistent. This advertising content in the uploaded video may be analyzed to determine which videos are used in the final promotional video.

Further, in some embodiments, marketing material and information may be added or overlaid on the media automatically by the system or by the system administrators. Data meeting the requirements to display may be selected and automatically spliced or stitched together based on statistical information providing the most heightened emotions or creating a heightened impulse to buy the marketed products. The images received from different fans may be stitched together to provide a three hundred and sixty degree image of the sports venue and any graphics may be overlaid.

At a step 312, the system may determine the best data to be used and analyze the data to determine additional information associated with the data such as metadata, time, location, user information, and information associated with the mobile device 204. The system may combine any data that is associated with the fan-generated data and may use the additional data to determine time, location, and mobile device 204 orientation. The additional information gathered by the system may be used to determine a likely time and location of recording events.

The system may select fan media based on content and the media may be combined into a composite product for display and distribution. The application may scan the fan provided media for AR markers at specific locations and at specific times. The mobile device 204 and the media upload may also be scanned for sensor events such as noise, acceleration, or any other sensor output associated with the mobile device 204. This may be usable along with images.

The media may also be selected based on the fan 202. For example, the system may analyze the media uploaded by fans with higher loyalty memberships first. This incentivizes fans to maintain higher loyalty membership. The system may also analyze media uploaded by fans that have a history of providing useful media. For example, fans that have provided useful media in the past may be regarded as high volume and high quality media providers and analysis of their media is performed first.

The high quality and high volume providers may also get higher rates or better incentives. For example, a fan that uploads a video for the first time may receive first time offers such as reduced concessions while a fan that uploads media that has a history of providing quality media may receive sponsorship money. The incentives may also be based purely on content such that a more competitive environment is created between all media providers.

At a step 314 the system may use the combined data and splice the data with data generated by other fans 208. The system may stitch the data together creating a montage of images or video that may be used for promotion and playback. The data that is chosen for assembly may be data including markers such as promotional products or may be a promotional video for the team depicting exciting moments during the game as described in embodiments above. For example, the application may select the best video from a plurality of fan-provided videos. The video may display a touchdown by the home team with a beverage sponsor sign in the back of the end zone. The fan 202 may have a good vantage point but the audio associated with the video is not usable. Similarly, media uploads may be scanned for audio only at the time of the event such that the audio may be spliced together with the video to create a complete experience. The composite multimedia may then be displayed at the sporting event or on broadcast television or online.

At a step 316, the fan 202 that uploaded the fan-generated data may receive offers and rewards as described in regard to the incentives at step 304 and as described in embodiments herein. For example, rewards may be provided including reduced or discounted tickets, or the fan 202 may receive payment as money or loyalty points based at least in part on the data submitted. The value of the payment may be based on the loyalty of the fan 202 or the media uploaded. The value may also be based on the number of instances of a particular product or marker in the media. The payment may also be based on a pre-arranged price for the fan-generated data. In some embodiments, the fan 202 may be a professional photographer or cameraperson and may be contracted to collect the data promote the application.

At a step 318, the final assembled and produced product may be sent to the fans for viewing on the mobile devices 208. The final product may also be distributed through social media, broadcasting stations, live-streaming platforms, and displayed on a display screen at the sporting venue. The number of views and shares on social media, or any other platform, may be tracked to determine the most successful videos and compensation from endorsements. Characteristics of the most successful videos may be stored as parameters and used in statistical analysis to determine the characteristics that make up the most successful videos. Any future media may be combined based on the history of success including the characteristics and markers in the historical media.

At a step 320, the system may be updated with the parameters that make up the most successful videos. Future videos may then be automatically assembled according to the new parameters thus optimizing the creation of the videos based on the chosen video characteristics.

In some embodiments, the system may track the sales of the products depicted in the advertisements and over time develop statistical models that predict the sales based on the data, markers, locations, times, and any other information that may provide sales correlations. In this way, the data (e.g., video, audio, and images) may be collected and used in ways that provide optimal sales based on the media, sporting events, times, and locations analyzed. The users may receive suggestions, or instructions, on collecting data such that the fans collect information with a higher likelihood of being used for the advertisements and promoting sales.

In some embodiments, the steps to perform methods described herein may be combined, omitted, or organized in different ways. For example, step 304 is performed to create a more efficient system. This step may be omitted and the data sent to the central database for full analysis resulting in a same or similar outcome.

Additional exemplary uses of embodiments of the invention may include promotional purposes such as recruiting parents or students for sports organizations and encourage parents to get involved in sports and community activities. For example, the final promotional videos may be sent to parents of a high school sports team to recruit new members for the parent organizations. The videos may also be sent to parents of non-athletes to encourage participation in sports. The promotional videos may be used for fund raising for athletic equipment or for traveling teams.

Further, embodiments of the invention may be used to notify people of events. For example, a user may be traveling to a downtown city location. Upon arriving downtown, the user encounters blocked streets and thousands of people. The user checks the application on the mobile device and discovers that the downtown marathon is underway. Alternatively, on the way downtown the application may recognize that the user is in close proximity to the downtown marathon and the application may automatically alert the user via the mobile device that the marathon is underway. The application may automatically provide the user with a location of the marathon and some advertisements from fan-generated media encouraging the user to attend. Further, the application may automatically send incentives to the user if the user attends and provides media coverage of the event.

In alternative embodiments of the invention, the system may be used for non-sporting activities such as in the identification or apprehension of fugitives at the sporting event or not, or in emergency situations. For example, fan at the sporting event may commit a crime such as assault or theft and the fan-generated media may be used to catch the criminal. Further, the police may issue an amber alert for a missing child and give a description for a particular vehicle. The police may review information gathered through the application and many uploads may be submitted at a time and a place on the highway. The police may view uploaded images and videos and track the vehicle's route. The police may use the information to locate and apprehend the suspect from the uploaded videos. Additionally, videos, images, messages, and the like may be uploaded depicting an accident such that emergency first responders may have a visual description of a fire or accident and may be able to plan prior to arriving at the scene of the emergency. In this way, the emergency technicians will already be prepared to perform the actions necessary thus saving valuable time.

Some embodiments of the invention utilize machine learning, neural networks, fuzzy logic, or any other statistical, or general mathematical algorithm or artificial intelligence to increase the efficiency of the application and create a more user-friendly experience. The mathematical algorithms may be used along with user feedback to increase customer satisfaction.

Although the invention has been described with reference to the embodiments illustrated in the attached drawing figures, it is noted that equivalents may be employed and substitutions made herein without departing from the scope of the invention.

The invention claimed is:

1. A method of analyzing user-supplied media at a sporting event, the method comprising the steps of:

collecting data from a mobile device at the sporting event, wherein the data is indicative of activities at the sporting event;

determining that the data is indicative of an event;

processing the data for display and distribution of the event wherein the event is displayed on at least one of social media, broadcast television, radio, and a display at the sporting event;

distributing the data for broadcast of the event;

providing rewards to a user of the mobile device based at least in part on the data; and tracking at least one of a quantity of shares and a quantity of views of the event and comparing information indicative of the event with historic information to determine a potential indicator of the quantity of shares and the quantity of views.

2. The method of claim 1, further comprising the steps of:

performing a first analysis to determine if the data meets a first threshold for quality; and performing a second analysis to determine if the data meets at least one requirement for distribution.

3. The method of claim 1, further comprising the step of selecting at least one set of data based on the comparison of information indicative of the event with the historic information.

4. The method of claim 3, further comprising the steps of:

analyzing sensor data from the mobile device to determine at least one of time and orientation of the mobile device, and determining a likelihood that the event was captured by at least one other mobile device.

5. The method of claim 4, further comprising the step of combining the at least one set of data with secondary data from the at least one other mobile device when it is determined that the at least one other mobile device is oriented to capture the event.

6. The method of claim 1, further comprising the step of initiating storage of the data when it is determined that a triggering event has occurred, wherein the data is prerecorded such that data prior to storage initiation is stored.

7. The method of claim 6, wherein the triggering event is detected by at least one of an accelerometer, a gyroscope, a microphone, and a camera associated with the mobile device.

8. The method of claim 6, further comprising the step of sending a notification to at least one other user when the at least one other user is within a specified proximity of the sporting event.

9. The method of claim 1, wherein the data is a first set of data; and further comprising the step of analyzing the first set of data with a second set of data, wherein the second set of data comprises at least one marker indicative of the event.

10. The method of claim 9, wherein the at least one marker comprises at least one of a location of the event, an orientation of the mobile device, or a location of the mobile device.

11. The method of claim 9, wherein the at least one marker comprises at least one of an artificial reality marker, an object at the sporting event, or a sound.

12. The method of claim 9, wherein the second set of data is collected by a second fan attending the sporting event, and wherein the second fan is rewarded for submitting the second set of data.

13. A method of analyzing user-supplied media at a sporting event, the method comprising the steps of:

collecting data from a mobile device at the sporting event, wherein the data is indicative of activities at the sporting event;

determining at least one marker from the data, wherein the at least one marker is indicative of an event wherein the event is displayed on at least one of social media, broadcast television, radio, and a display at the sporting event;

providing rewards to a user of the mobile device based at least in part on the data and tracking at least one of a quantity of shares and a quantity of views of the event and comparing information indicative of the event with historic information to determine a potential indicator of the quantity of shares and the quantity of views.

14. The method of claim 13, wherein the data is a first set of data; and further comprising the step of combining the first set of data with a second set of data, wherein the second set of data comprises the at least one marker.

15. The method of claim 14, wherein the at least one marker comprises at least one of a location of the event, an orientation of the mobile device, or a location of the mobile device.

16. The method of claim 14, wherein the at least one marker comprises at least one of an artificial reality marker, an object at the sporting event, or a sound.

17. The method of claim 16, wherein the second set of data is collected by a second fan attending the sporting event, and wherein the second fan is rewarded for submitting the second set of data.

18. One or more non-transitory computer-readable media storing computer-executable instructions that, when executed by a processor, perform a method of analyzing user-supplied media at a sporting event, the method comprising the steps of:

collecting a first set of data from a first mobile device at the sporting event, wherein the first set of data is indicative of activities at the sporting event;

determining at least one marker in the first set of data;

collecting a second set of data from a second mobile device at the sporting event;

wherein the second set of data is indicative of the activities at the sporting event;

combining the first set of data and the second set of data to create a combined set of data based at least in part on the at least one marker;

displaying the combined set of data on at least one of a social media platform, a display at the sporting event, broadcast television, or a live-streaming platform;

tracking a distribution of the combined set of data; and analyzing and comparing the combined set of data to saved data to determine correlations to the distribution.

19. The media of claim 18, wherein the at least one marker is indicative of a product associated with the sporting event; and further comprising the step of determining if the second set of data comprises the at least one marker.

20. The media of claim 19, further comprising the step of initiating storage of the first set of data when it is determined that the at least one marker is obtained.

* * * * *